US006263871B1

(12) United States Patent
Brown et al.

(10) Patent No.: US 6,263,871 B1
(45) Date of Patent: Jul. 24, 2001

(54) MOUTHPIECE WITH COUPLER

(76) Inventors: Richard I. Brown, 2335 Peachtree La., Northbrook, IL (US) 60062; David S. Brown, 7940 Dada Dr., Gurnee, IL (US) 60031

( * ) Notice: Subject to any disclaimer, the term of this patent is extended or adjusted under 35 U.S.C. 154(b) by 0 days.

(21) Appl. No.: 09/558,181

(22) Filed: Apr. 26, 2000

Related U.S. Application Data

(63) Continuation-in-part of application No. 09/182,619, filed on Oct. 29, 1998, now Pat. No. 6,089,225.

(51) Int. Cl.[7] ..... B63C 11/02

(52) U.S. Cl. ..... 128/200.29; 128/201.27

(58) Field of Search ..... 128/200.29, 200.27, 128/201.11, 201.26, 201.27, 201.28, 204.26, 206.29, 861, 912, 909, 205.24, 206.22; 405/185–187; 114/326, 315

(56) References Cited

U.S. PATENT DOCUMENTS

| | | | | |
|---|---|---|---|---|
| 2,485,039 | | 10/1949 | Cousteau et al. | 128/145 |
| 2,747,572 | | 5/1956 | Gagnan | 128/145 |
| 2,865,369 | | 12/1958 | Kline | 128/142 |
| 3,101,732 | * | 8/1963 | Valle | 128/201.27 |
| 3,147,499 | | 9/1964 | Nelson et al. | 9/313 |
| 3,669,109 | | 6/1972 | Cheffers et al. | 128/147 |
| 4,002,166 | * | 1/1977 | Oliver | 128/201.27 |
| 4,010,746 | * | 3/1977 | Pedersen | 128/201.27 |
| 4,079,735 | | 3/1978 | Gaffney | 128/142.2 |
| 4,159,717 | * | 7/1979 | Cossey | 128/201.27 |
| 4,304,229 | | 12/1981 | Curtin | 128/201.11 |
| 4,345,592 | | 8/1982 | Giorgini et al. | 128/204.46 |
| 4,345,593 | | 8/1982 | Sullivan | 128/204.26 |
| 4,356,820 | | 11/1982 | Trinkwalder | 128/204.26 |
| 4,460,089 | * | 7/1984 | Abbott | 128/201.27 |
| 4,467,797 | * | 8/1984 | Franke | 128/204.26 |
| 4,784,129 | * | 11/1988 | Garraffa | 128/200.29 |
| 4,815,893 | | 3/1989 | Feder | 405/186 |
| 4,862,903 | * | 9/1989 | Campbell | 128/861 |
| 5,203,324 | | 4/1993 | Kinkade | 128/201.11 |
| 5,315,987 | | 5/1994 | Swann | 128/201.28 |
| 5,379,762 | | 1/1995 | Kobayashi | 128/201.28 |
| 5,455,842 | * | 10/1995 | Mersky et al. | 375/175 |
| 5,524,612 | * | 6/1996 | Chen | 128/202.15 |
| 5,570,702 | | 11/1996 | Forman | 128/842 |
| 5,584,285 | * | 12/1996 | Salter et al. | 128/200.21 |
| 5,660,502 | * | 8/1997 | Ferguson | 405/186 |
| 5,701,885 | | 12/1997 | Hale | 128/201.26 |
| 5,724,961 | * | 3/1998 | Tistrand | 128/205.24 |
| 5,755,222 | | 5/1998 | Pansard et al. | 128/204.27 |
| 5,771,885 | | 6/1998 | Putrello | 128/205.27 |
| 5,775,323 | * | 7/1998 | Knott | 128/202.27 |
| 5,829,432 | | 11/1998 | Semeia | 128/201.27 |
| 5,871,011 | | 2/1999 | Howell et al. | 128/206.22 |
| 6,039,043 | * | 3/2000 | Graber et al. | 128/202.14 |

FOREIGN PATENT DOCUMENTS 2744693 8/1997 (FR) .

* cited by examiner

*Primary Examiner*—Aaron J. Lewis
*Assistant Examiner*—Teena Mitchell

(57) ABSTRACT

A mouthpiece is provided having a quick connect coupler to facilitate the rapid replacement of mouthpieces for use with breathing devices that may be used by many different individuals, such as in diver training classes and rental operations. In a preferred embodiment, the mouthpiece has a coupler including a pin to engage and lock with a slot in an opening of the regulator housing. The mouthpiece can further include one-way inhalation and exhalation pathways to prevent pathogenic entities in the exhalation and saliva of the diver from contaminated the body of the regulator. An exhaust tee is provided to direct bubbles away from the diver's line of vision. The regulator housing can further include an independent exhaust valve opening. A seal is provided to prevent the regulator body from flooding through the exhaust valve opening when the regulator is used with a mouthpiece having its own exhalation pathway. A flapper valve replaces the exhaust valve opening seal to permit conventional operation when the regulator is used with a conventional mouthpiece after being taken out of service for use by multiple users.

29 Claims, 3 Drawing Sheets

MOUTHPIECE WITH COUPLER

This application is a continuation-in-part of application Ser. No. 09/182,619, filed Oct. 29, 1998, now U.S. Pat. No. 6,089,225.

FIELD OF THE INVENTION

The present invention relates to mouthpieces used with breathing devices and, more particularly, to mouthpieces used with second stage regulators in underwater breathing devices.

BACKGROUND OF THE INVENTION

Regulators are breathing devices that allow scuba divers to breathe air, or the like, while under water. The regulator uses valves to release air from high pressure tanks, typically through the action of an inhalation responsive diaphragm. Most often, a first stage regulator is attached to the tank. A second stage regulator is then connected to the first by a flexible hose and is supported by a mouthpiece retained in the mouth of the diver. This configuration requires minimal breathing effort since it locates the inhalation responsive elements closer to the center of pressure of the diver's lungs.

Regulators are frequently shared by many divers, especially in rental operations and diver training programs. Pathogenic entities from one diver can be transmitted to the next. Some bacteria, such as tuberculosis, have become resistant to antibiotics. Hepatitis is difficult to kill and can survive on dry surfaces for great periods of time. And lethal new viruses, such as HIV, Marburg, and Ebola are emerging with an alarming frequency. Regulators are rinsed with fresh water after use, but this has little pathogen inactivating value. There is growing concern over this problem and some instructional agencies have even discontinued the so-called buddy breathing exercise of passing the same regulator back and forth between two divers.

U.S. Pat. No. 5,755,222, to Pansard and U.S. Pat. No. 5,829,432 to Semeia disclose fasteners to facilitate mouthpiece replacement and many rental operations now require divers to use their own personal mouthpieces. However, it is not enough to simply replace the mouthpiece to prevent the transmission of pathogenic entities between divers who share a common regulator. Pathogenic entities can also be carried past the mouthpiece and into the regulator with exhaled air and saliva, and once there, can be transmitted to the next user. In our previous patent application, we disclosed a mouthpiece having integral unidirectional fluid pathways to prevent pathogens in the divers exhalation and saliva from contaminating the regulator itself.

It is becoming increasingly common for divers to replace the mouthpiece of diving regulators before use. But even with quick release fasteners, it is not always easy to replace the mouthpiece. Not all regulator ports are the same size and it is sometimes difficult to fit a small mouthpiece over a large port and anchor it in place with a fastener, particularly if the divers hands are cold and wet.

One problem encountered when a mouthpiece having an integral exhaust port is used with a second stage diving regulator is that bubbles can pass in front of the diver's face and obscure his line of vision during exhalation. Although not a safety issue, bubbles can be irritating to the diver.

Second stage regulators have an exhaust port built into the regulator housing. When used with a mouthpiece having its own integral exhaust pathway, the exhaust port in the regulator housing can be used to help clear the regulator of water should it become flooded but may allow water to leak into the regulator. One diver may wish to make use of the exhaust port in the regulator while another diver might not. And so the problem arises as to what to do with the exhaust port in the regulator when the regulator is being used with a mouthpiece having its own integral exhaust pathway.

SUMMARY OF THE INVENTION

Accordingly, it is an object of the present invention to provide a breathing device with an easily replaceable mouthpiece.

It is another object of the present invention to provide a breathing device with an easily replaceable mouthpiece that prevents the transmission of pathogenic entities between the users of common-use breathing devices.

It is still another object of the present invention to provide a mouthpiece for use by student divers that permits practicing buddy-breathing without the risk of transmitting communicable diseases.

It is yet another object of the present invention to provide a diving regulator for use with a mouthpiece having an integral exhaust pathway that directs bubbles away from the diver's line of vision.

It is yet another object of the present invention to provide a diver with a regulator having a housing including an exhaust port that the diver can enable or disable at his option.

The present invention accomplishes its intended objectives by providing a breathing device with a detachable mouthpiece having a coupler adapted to quickly and easily attach the mouthpiece to the device. In the preferred, but non-limiting embodiment, a mouthpiece is connected to a second stage diving regulator. The mouthpiece further includes one or more noretum fluid pathways to prevent saliva and exhaled air with their attendant pathogens from entering the body of the regulator. The embodiment further includes a bubble deflector to direct exhaled bubbles away from the diver's line of vision. In addition, the regulator housing includes an exhaust port that can be either sealed or fitted with an exhaust valve at the user's discretion.

Further characteristics and advantages of the mouthpiece and coupler of the present invention will become apparent from a description of the preferred embodiment given hereinafter.

DETAILED DESCRIPTION OF THE INVENTION

Figure 1:
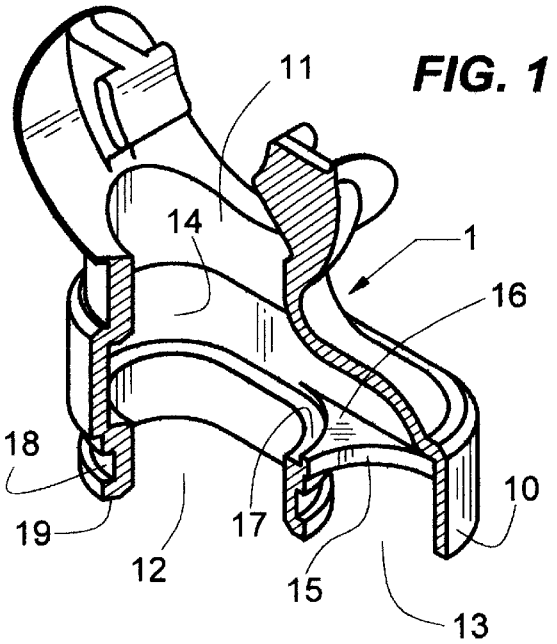
FIG. 1 is an isometric view, shown in partial section, of a mouthpiece body suitable for use in the present invention.
Figure 2:
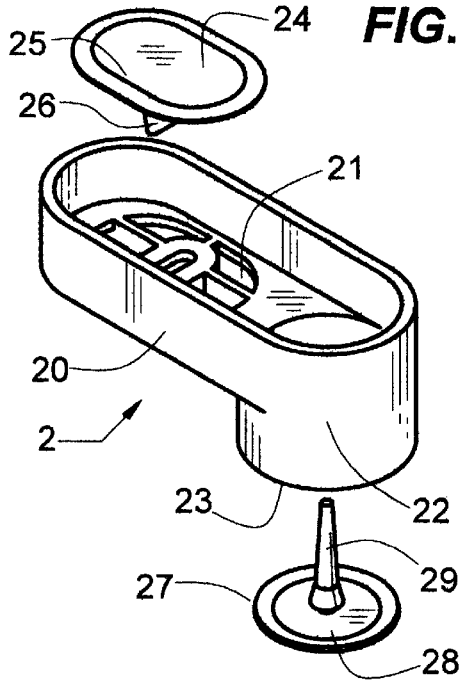
FIG. 2 is an exploded view of a valve assembly adapted for installation into the mouthpiece body of FIG. 1.

Many student divers may use the same diving regulator, thus incurring the risk of spreading or contracting a communicable disease. FIG. 1 shows a mouthpiece body 1 that can be fitted with valve assembly 2 of FIG. 2 to provide a means through which the transmission of pathogens between divers can be prevented. Referring now to FIG. 2, valve assembly 2 comprises valve plate 20, inhalation valve 24, and exhaust valve 27. Inhalation valve 24 is of known construction and comprises flapper 25 with integral barbed stem 26 and can be fabricated in an elastomer such as silicone or neoprene rubber. Valve plate 20 includes web structure 21 of known construction to receive and retain stem 26 of inhalation valve 24 and to provide a plurality of openings through which air may flow. When installed in valve plate 20, inhalation valve 24 forms a conventional no-return valve that permits flow in one direction while blocking flow in the other. Exhaust valve 27 comprises flapper 28 having integral barbed stem 29 adapted to be installed into and retained by a similar web structure, not shown, located within barrel 22 of valve plate 20.

Referring again to FIG. 1, mouthpiece body 1 having mouthgrip opening 11 is provided to receive valve assembly 2. Mouthpiece body 1 can be fabricated in an elastomer such as silicone or neoprene rubber with sufficient flexibility to allow valve assembly 2 to be inserted through opening 13 in side-arm 10. Valve plate 20 is retained by recess 14 and surface 16. Mouthpiece body 1 can be slightly under-sized so that seals are formed by the interference of valve plate 20 with recess 14 and barrel 22 with wall 15. As disclosed in our previous patent application, sleeve 12 can be fitted over the conventional flanged mouthpiece tube of a second stage diving regulator and used to provide a first one-way fluid pathway from the regulator to the diver for inhalation and a second one-way fluid pathway from the diver to the ambient for exhalation; thereby preventing pathogens in the divers exhalation and saliva from contaminating the regulator.

Inhalation valve 24 and exhaust valve 27 have been illustrated as conventional mushroom type valves. No such limitation is intended as any type of no-return valve can be made to work in such a mouthpiece. For instance, duck-bill, spring loaded plate, ball and cup, and swing plate types of no-return valves can be easily adapted for use with this type of mouthpiece. Applying a differential pressure to these types of no-return valves creates a fluid pathway gap through which fluid may pass. It has been found the fluid pathway gap of the exhaust valve needs to be located as closely as possible to the regulator body to prevent the mouthpiece from free-flowing while in use by the diver. Preferably, the distance between the geometric center of end 19 of sleeve 12 of mouthpiece body 1 and all portions of the fluid pathway gap formed by an exhaust valve when it opens should be less than 2.5 inches to prevent the regulator from free-flow through the mouthpiece exhaust valve when used with most regulators of the type used in diver training classes.

Divers occasionally remove the regulator from their mouths while under water. Due to the differential pressure established between the diaphragm of the regulator and a mouthgrip opening, a regulator can go into free-flow if held in a mouthgrip-up position. Ordinarily, the regulator will flood with water, thereby removing the differential pressure, and preventing this type of free-flow. Unlike a regulator fitted with a conventional mouthpiece, a regulator fitted with a mouthpiece having a no-return inhalation valve cannot fill with water when out of the diver's mouth and is, therefore, more prone to free-flow. The sensitivity of regulators varies, but it has been found that if the spacing between the inhalation valve and end 19 of mouthpiece body 1 can be kept to a minimum, the tendency of less sensitive regulators to free-flow when out of the divers mouth can be suppressed. Preferably, the distance between the geometric center of end 19 of sleeve opening 12 of mouthpiece body 1 and all portions of the fluid pathway gap of the inhalation valve when it opens should be less than 2.5 inches.

Figure 4:
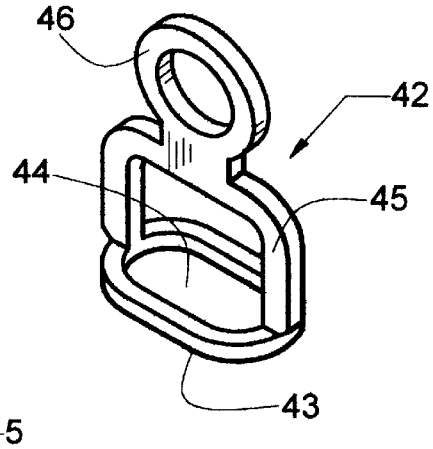
FIG. 4 is an isometric view of an anti free-flow plug adapted for use with the mouthpiece body in FIG. 1.

Modem regulators employ two second stage regulators, a first through which the diver ordinarily breathes and a second to act as a backup unit in the event of an emergency. It has been found that even when the inhalation valve is close enough to the regulator or to keep the regulator from free-flowing when out of the diver's mouth, the regulator can begin to free-flow if the purge button is jarred or jolted. Venturi effects then take over and cause the free-flow to become self-sustaining, rapidly depleting the divers air supply. Anti free-flow plug 42, shown in FIG. 4, can be inserted through mouthgrip opening 11 and located so that plate 43 prevents flapper 25 of inhalation valve 24 from opening when the regulator is not in use, thus preventing the regulator from going into a free-flow condition. Side members 45 interfere with the walls of mouthgrip opening 11 and prevent plug 42 from accidentally falling out of mouthpiece body 1. Plug 42 further includes handle 46 to be grasped by the diver to remove the plug when the mouthpiece is to be used for breathing. Plate 43 has opening 44 to break the suction between plate 43 and flapper 25 so that inhalation valve 24 does not open when plug 42 is removed.

The circumference of sleeve opening 12 can vary from 2.5 to 4 inches and still be made to effect a seal with some regulator mouthpiece tubes, but it has been found that a circumference of approximately 3.25 inches forms a seal with the mouthpiece tubes of nearly all regulators. Nevertheless, it can be difficult and time-consuming for the diver to fit sleeve 12 over the flanged mouthpiece tube of a conventional second stage regulator and to orient it in the proper direction. In addition, the mouthpiece must then be locked in place with a cable tie or some other form of anchoring device, a step frequently requiring tools. When the dive is completed, the diver must reverse the process; first releasing the anchor and then removing the mouthpiece. And again, releasing the anchor may require a special tool or cutter, particularly if a cable tie has been used. Both installing and removing a mouthpiece can be especially difficult if the divers hands are cold and wet.

Figure 3:
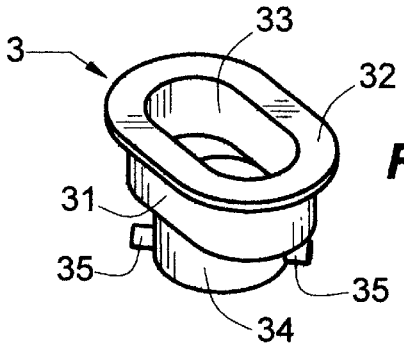
FIG. 3 is an isometric view of a coupler adapted to facilitate the connection of a mouthpiece to a second stage regulator housing.

One aspect of the invention provides a coupler to simplify the attachment of a mouthpiece to a regulator. Coupler 3, shown in FIG. 3, comprises body 31 having flange 32 and is adapted to fit through and be retained in mouthpiece sleeve opening 12. Flange 32 is received into recess 17 of mouthpiece body 1. Body 31 and flange 32 are preferably manufactured with dimensions to approximate those of a typical flanged mouthpiece tube of a conventional second stage regulator. In particular, body 31 has a circumference of between 2.5 and 4 inches and preferably 3.25 inches, and has a length of from 0.25 to 1.5 inches, but preferably approximately 0.5 inches. Coupler 3 further includes a barrel 34 having pins 35 to form half of a so-called bayonet type connector. Coupler 3 further comprises a flow-through hole 33 to permit air from the regulator to flow into mouthpiece body 1.

Figure 5:
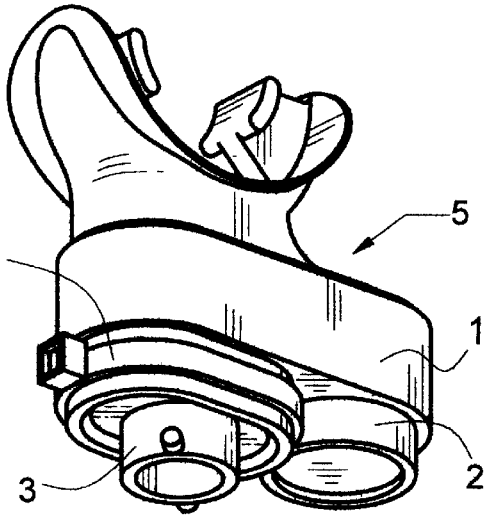
FIG. 5 is an isometric view of a mouthpiece assembly of the present invention.
Figure 6:
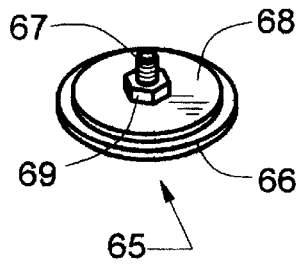
FIG. 6 is an isometric view of a seal assembly suitable for use with the exhaust port in the regulator housing.

Coupler 3 and valve assembly 2 are both installed into mouthpiece body 1. The elements of the mouthpiece need only be assembled once. The resulting assembly is shown as mouthpiece assembly 5 in FIG. 5. A cable tie 4 is installed into recess 18 and tightened to form a water-tight seal between sleeve opening 12 and coupler 3 and to anchor coupler 3 in place inside mouthpiece body 1.

Figure 7:
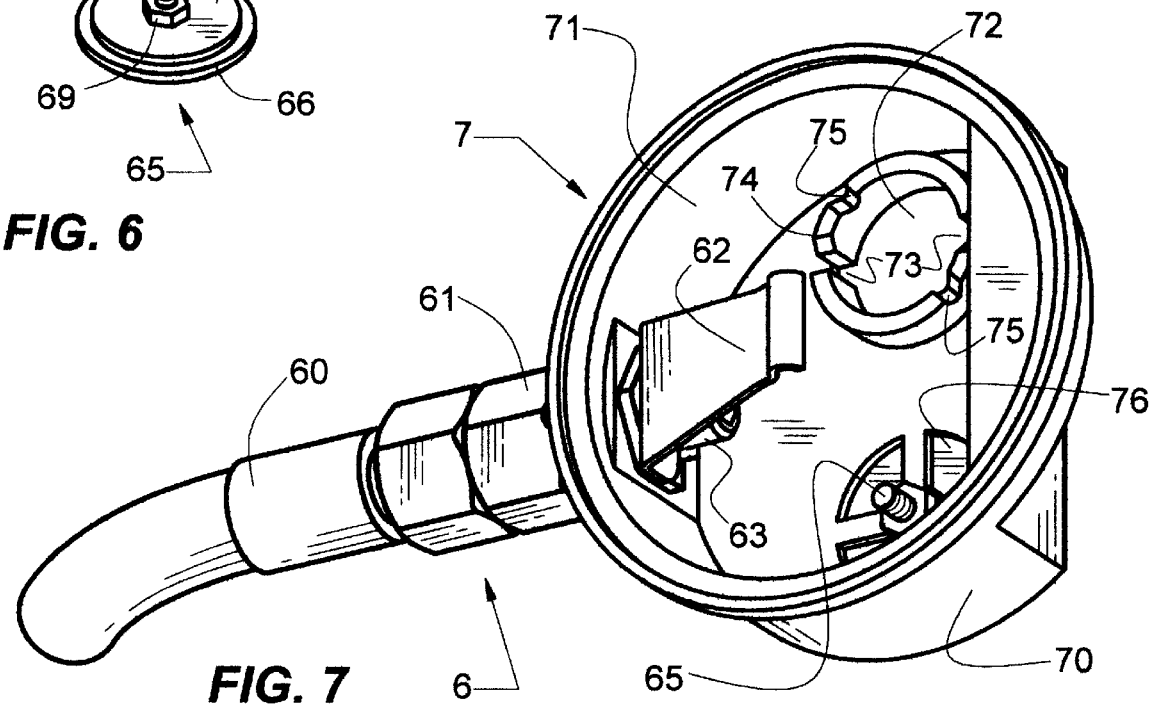
FIG. 7 is an isometric view of a regulator housing assembly adapted to receive the mouthpiece assembly of FIG. 5.
Figure 8:
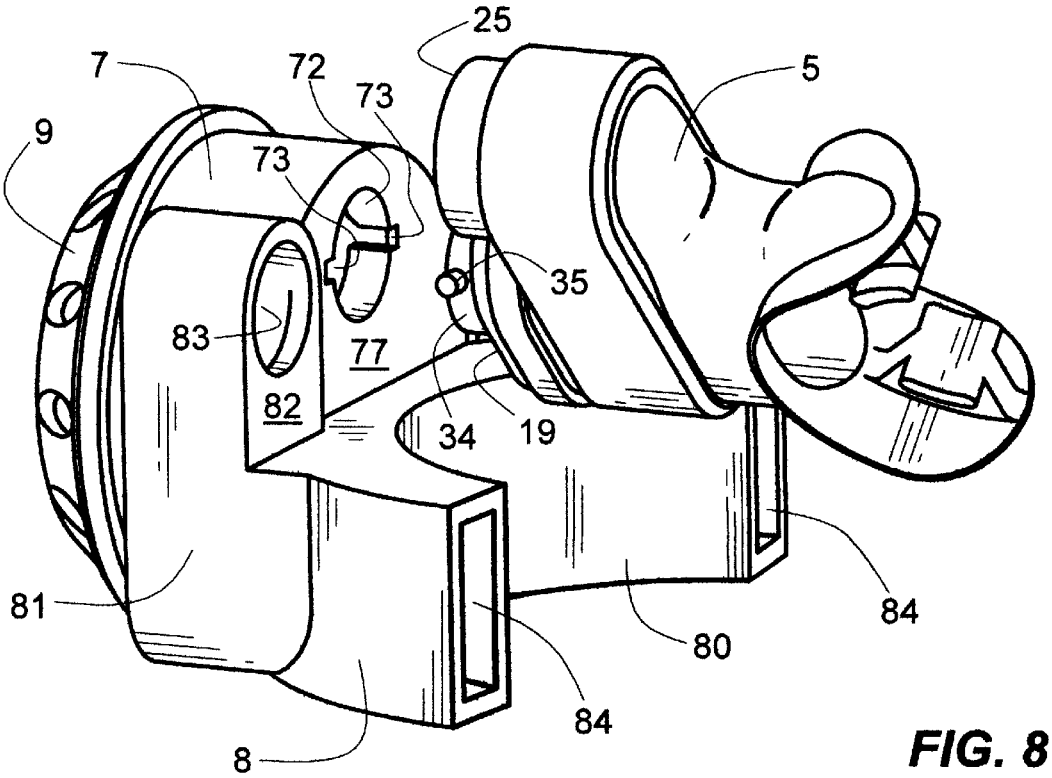
FIG. 8 is an isometric view of the mouthpiece assembly of FIG. 5 positioned for installation into the regulator assembly the FIG. 7.

A regulator suitable for use with mouthpiece assembly 5 is shown in FIG. 7. Regulator assembly 7 comprises regulator housing 70 having an air delivery assembly 6 comprising flexible hose assembly 60, valve body 61, and valve assembly 63. Valve assembly 63 is adapted to release air when lever 62 is depressed by the deflection of a diaphragm in response to inhalation by the diver in a known manner. The diaphragm is not shown. The regulator further comprises a cover 9 as shown in FIG. 8. Cover 9 can further include a purge button, not shown but also of known construction, to permit the diver to manually release air from valve assembly 63 if so desired. Housing 70 forms an inhalation chamber 71.

Figure 9:
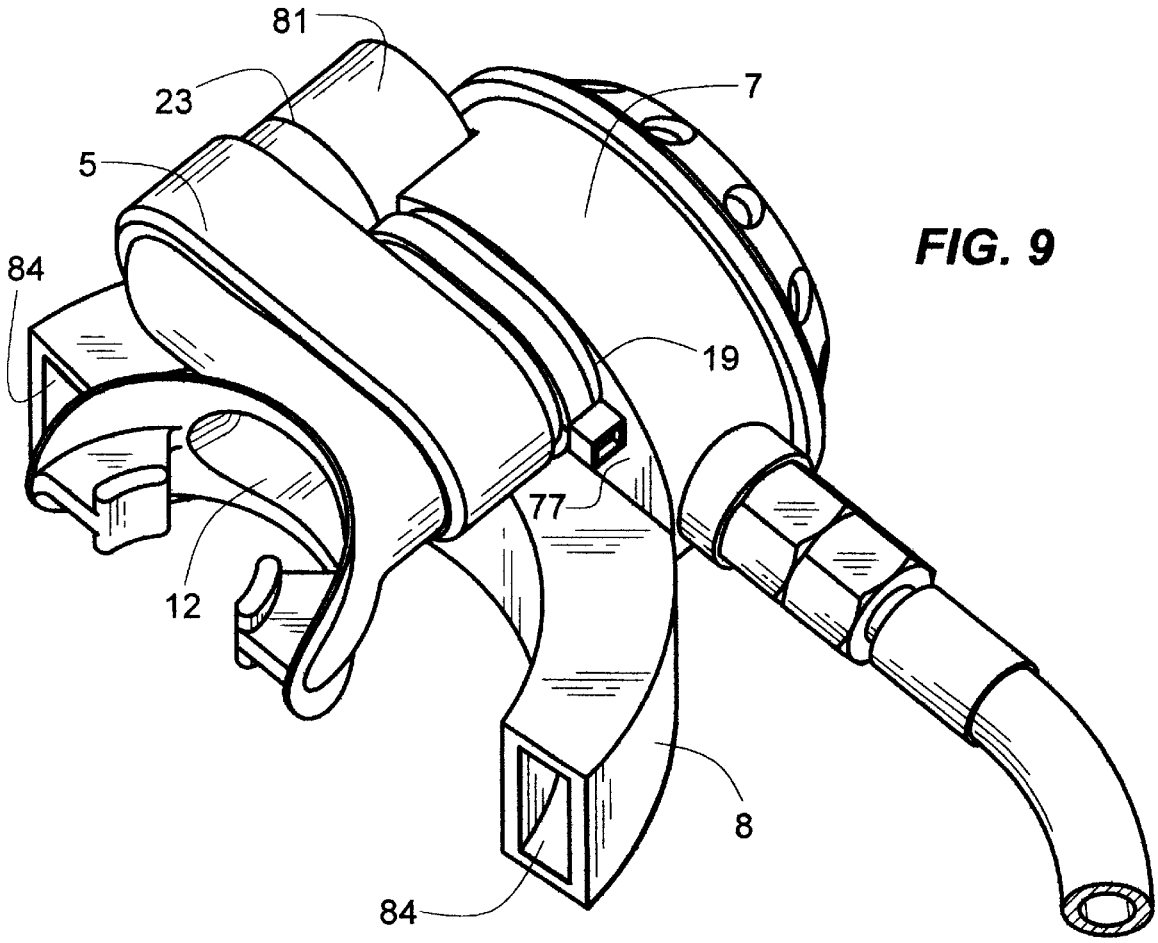
FIG. 9 is an isometric view of the mouthpiece assembly of FIG. 5 fully installed into the regulator assembly of FIG. 7.

Housing 70 includes opening 72 having slots 73 terminating in contoured planes 74, only one of which is fully visible in the illustration. As best shown in FIG. 8, coupler barrel 34 and pins 35 are inserted through opening 72 and slots 73 in regulator housing 70. Once inserted, mouthpiece assembly 5 is given a partial turn so that pins 35 slide up and over contoured planes 74 and lock into place in recesses 75. The final position of mouthpiece assembly 5 is shown in FIG. 9. A water-tight seal is formed by the contact of end 19 of mouthpiece body 1 with surface 77 of regulator housing 70. The resilience of mouthpiece body 1 creates a force to lock coupler 3 snuggling in place. Mouthpiece assembly 5 can be removed by depressing and twisting it to release pins 35 from recesses 75 and aligning them with slots 73 for withdrawal. No tools or cutters are required to attach or detach mouthpiece assembly 5 to or from regulator housing 70.

Mouthpiece assembly 5 can be attached to and detached from regulator housing 70 very rapidly, and can be done so even when the diver's hands are cold and wet. The connection can even be made underwater and allows student divers to once again practice buddy breathing without having to share a common mouthpiece and without incurring the risk of transmitting communicable diseases. The first diver takes the regulator out of his mouth, detaches his mouthpiece and hands the regulator to his partner. His partner then attaches his mouthpiece, depresses the purge button to clear the regulator of any water that may have leaked in during the transfer, and places the regulator in his mouth.

Referring again to FIG. 8, regulator housing 70 can further include exhaust tee 8. Exhaust tee 8 comprises exhaust tee body 80 that can be either an integral part of or a separate member attachable to regulator housing 70. Exhaust tee body 80 further includes up-standing arm 81 having opening 83 in face 82. Exhaust tee 8 is hollow and provides an exhaust pathway to divert bubbles away from the diver's line of vision. When mouthpiece assembly 5 is attached to regulator housing 70 and rotated into place (as best shown in FIG. 9), the diver's exhalation passes through exhaust valve 27, enters opening 83, and exhausts at one or both of openings 84. End 23 of valve plate 20 may contact exhaust tee face 82 to form a seal if so desired, although only close proximity is all that is required to divert bubbles away from the diver's line of vision.

When used with a mouthpiece having its own exhalation pathway, such as that of mouthpiece assembly 5, regulator housing 70 does not need to have an exhaust pathway leading to the ambient. However, it can sometimes be useful to have an exhaust pathway leading directly from inhalation chamber 71, particularly in the event that the regulator becomes flooded and it is necessary to clear it of water. To this end, and referring now to FIG. 7, regulator housing 70 can further include exhaust openings 76 which, when fitted with a no-return exhaust valve of construction similar to that of exhaust valve 27 of FIG. 2, can provide an independent exhaust pathway to the surrounding water from inhalation chamber 71. If the regulator assembly includes exhaust tee 8 and if exhaust tee 8 is not already so equipped, a hole can be bored in the back of exhaust tee 8 to provide clearance for a no-return exhaust valve and to allow vented air to pass into exhaust tee 8 and out openings 84.

Alternatively, exhaust opening 76 can be closed with seal assembly 65. Seal assembly 65 comprises plate 66 having threaded post 67, rubber washer 68, and nut 69. Thus, the diver can have the choice of either providing inhalation chamber 71 with an independent exhaust pathway to the ambient surrounding water or sealing the pathway to prevent water from inadvertently leaking into housing 70. This is particularly advantageous if the diver chooses to take the regulator out of service as a common-use breathing device, or if a rental operator decides to sell off excess equipment. In this case, the diver can fit a conventional mouthpiece onto coupler 3 and use the regulator in a conventional manner. Opening 83 is sealable by known means.

Manufacturing Considerations

The regulator and its associated parts can be fabricated by conventional means. Regulator housing 70, cover 9, coupler 3, and valve plate 20 can all be molded in rigid structural engineering plastics such as ABS or fabricated in metals by known means. Mouthpiece housing 1 and inhalation and exhaust valves 24 and 27 can all be molded in elastomers such as silicone or neoprene. Exhaust tee 8 can be molded in either a rigid structural engineering plastic or in an elastomer, or can be an integral part of regulator housing 70.

As previously stated, the invention is not limited to the use of mushroom type no-return valves as there are numerous other types of valves known in the art that can be used with equal success. Nor is the number and placement of no-return valves along the fluid pathways within the regulator and mouthpiece limited to that shown in the preferred embodiment. Multiple valves could be used in series or parallel and placed inside or outside the envelopes of mouthpiece body 1 or regulator housing 70.

Coupler 3 and valve plate 20 have been illustrated as separate parts, but no such limitation is intended as they could be manufactured as a single entity. Or mouthpiece assembly 5 could be made up of separate no-return valves and the inhalation valve body could include coupler 3.

Mouthpiece body 1 has been illustrated as a singular molded entity, but, again, no such limitation is intended. Bodies could just as well be fabricated as multi-part assemblies and need not include a mouthgrip but can provide only a mouthpiece mounting neck so that the user could customize the mouthpiece in any manner so desired. Conversely, a mouthpiece housing with integral inhalation and exhaust valves could be molded as a single unit.

Figure 10:
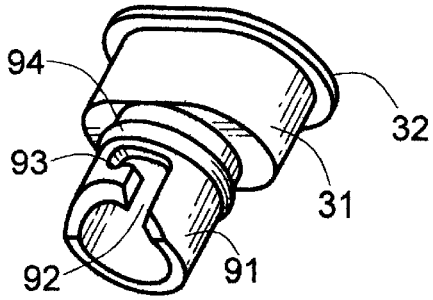
FIG. 10 is an isometric view of an alternate coupler suitable for use in the present invention.

Coupler 3 has been illustrated as a bayonet type connector with pins 35 mounted on barrel 34 of coupler 3 to mate with slots 73 in regulator housing 70. Here again, no such limitation is intended. Opening 72 and housing 70 could just as well have one or more pins and the barrel of a coupler could include one or more slots. One such alternate coupler is shown in FIG. 10. The coupler again has a body 31 with flange 32 and includes a hollow barrel 91 through which air may flow to the user. Barrel 91 further includes dog-legged slot 92 terminating at recess 93 to receive and retain a pin extending into a sleeve integral to regulator housing 70.

Nor is it intended that the invention be limited only to the use of bayonet type couplers. Many other types of connection means can be used with equal success. For instance, the coupler and regulator housing could meet in a threaded manner. Additional connection means include taper locks, ball and detent sockets, snap fits, clamps, hinges and latches, and the like. A connection can even be effected by magnets located in one or both of the coupler and regulator housing.

The invention has been illustrated as comprising a single coupler to mate with a regulator housing including a prefabricated coupler interface. Again, no such limitation is intended. An adapter can be fashioned to sealingly attach to the conventional mouthpiece tube of an ordinary regulator and can include the necessary geometry to connect to the mouthpiece coupler. Thus, the ease and simplicity provided by a coupler of the present invention can be extended to those regulators currently in use.

The illustrative embodiment shows coupler 3 to fit into sleeve opening 12, but again, no such limitation is intended. Mouthpiece body 1 and coupler 3 could just as well be manufactured so that a sleeve portion of mouthpiece body 1 could be made to fit into the body of coupler 3. Moreover, as disclosed above, a coupler could be used with any mouthpiece, whether it included one-way fluid pathways or not.

An absolutely water tight seal is not required between the mouthpiece and the regulator housing, as it is expected that the regulator will occasionally leak. The illustrative embodiment employs a face seal between end 19 of mouthpiece body 1 and regulator housing 70. Again no such limitation is intended. A coupler and regulator housing can employ other types of seals. For instance, the coupler can include an 'O'-ring as illustrated in FIG. 10. Barrel 91 includes 'O'-ring 94 to form a seal with a mating sleeve in a regulator housing (not shown).

While the present invention has been shown in what is thought to be its most practical embodiment, it will be apparent to those skilled in the art that numerous modifications can be made without departing from the novel scope of the invention. Hence, the proper scope of the present invention should be determined only by the broadest interpretation of the appended claims so as to encompass all such modifications and equivalents.

We claim:

1. A mouthpiece comprising:

a unitary housing having an inlet opening, a mouthgrip opening, and a vent opening;

a no-return inlet valve adapted to establish one-way fluid communication from said inlet opening to said mouthgrip opening during inhalation; and a no-return exhaust valve adapted to establish one-way fluid communication through said vent opening during exhalation, said no-return exhaust valve adapted to establish an exhaust gap through which an exhaled gas may pass;

wherein the distance between the geometric center of said inlet opening and any portion of said exhaust gap is less than 2.5 inches.

2. The mouthpiece of claim 1 wherein said no-return inlet valve is adapted to establish an intake gap through which a breathable gas may pass and the distance between any portion of said intake gap and the geometric center of said inlet opening is less than 2.5 inches.

3. The mouthpiece of claim 1 wherein said unitary housing includes a sleeve, and said inlet opening comprises an opening on said sleeve.

4. The mouthpiece of claim 1 further comprising a connection member, said connection member including a first half of a two-portion locking connector.

5. The mouthpiece of claim 4 wherein said first half of a two-portion locking connector is selected from the group of connectors comprising: threaded connectors; taper lock connectors; ball and detent connectors; snap fit connectors; clamp connectors; hinge and latch connectors; magnetic connectors; and bayonet type connectors wherein a first portion is inserted into a second portion and rotated into a locked position.

6. The mouthpiece of claim 1 wherein said unitary housing comprises: a body having said mouthgrip opening; and a coupler adapted to engage said body and including said inlet opening and a connection member.

7. A second stage regulator for conveying a breathable gas to a diver comprising:

a regulator housing having an inhalation chamber, a port opening, a first connection member, and a demand valve in communication with said inhalation chamber that releases said breathable gas to said port opening in response to inhalation through said port opening; and a mouthpiece attachable to said regulator housing, said mouthpiece comprising:

a unitary housing having an inlet opening, a mouthgrip opening, and a second connection member, said second connection member adapted to engage said first connection member; and at least one fluid pathway in said unitary housing adapted to establish one-way respiratory communication with said mouthgrip opening;

wherein said at least one fluid pathway includes a no-return valve adapted to establish a gap through which a fluid may pass, wherein the distance between the geometric center of said inlet opening and any portion of said gap is less than 2.5 inches.

8. The second stage regulator of claim 7 wherein said mouthpiece comprises a first no-return valve enabling the flow of said breathable gas during inhalation, and a second no-return valve enabling the flow of exhaled gas during exhalation.

9. The second stage regulator of claim 7 wherein said unitary housing comprises: a body having said mouthgrip opening; and a coupler adapted to engage said body and including said inlet opening and said second connection member.

10. The second stage regulator of claim 7 wherein said first connection member comprises a tube and said second connection member comprises a sleeve adapted to engage said tube.

11. The second stage regulator of claim 7 wherein said first connection member and said second connection member comprise the two halves of a locking connector.

12. The second stage regulator of claim 11 wherein said regulator housing includes a tube and an adapter, said adapter adapted to engage said tube and including said first connection member.

13. The second stage regulator of claim 7 wherein said unitary housing includes a vent opening through which exhaled gas may pass during exhalation; and said regulator housing further comprises an exhaust conduit having a first opening in fluid communication with the ambient and a second opening adapted to establish fluid communication with said vent opening.

14. The second stage regulator of claim 7 wherein said regulator housing includes: an exhaust opening adapted to establish fluid communication with the ambient; and a sealing member to block flow through said exhaust opening in at least one direction.

15. A second stage regulator for conveying a breathable gas to a diver comprising:

a regulator housing having an inhalation chamber, a port opening, a first connection member, and a demand valve in communication with said inhalation chamber that releases said breathable gas to said port opening in response to inhalation through said port opening; and a mouthpiece attachable to said regulator housing, said mouthpiece comprising:

a unitary housing having an inlet opening, a mouthgrip opening, and a second connection member, said second connection member adapted to engage said first connection member; and at least one fluid pathway in said unitary housing adapted to establish one-way respiratory communication with said mouthgrip opening;

wherein said first connection member and said second connection member comprise the two halves of a locking connector.

16. The second stage regulator of claim 15 wherein said unitary housing comprises: a body having said mouthgrip opening; and a coupler adapted to engage said body and including said inlet opening and said second connection member.

17. The second stage regulator of claim 15 wherein said locking connector is selected from the group of connectors comprising: threaded connectors; taper lock connectors; ball and detent connectors; snap fit connectors; damp connectors; hinge and latch connectors; magnetic connectors; and bayonet type connectors wherein a first portion is inserted into a second portion and rotated into a locked position.

18. The second stage regulator of claim 15 wherein said mouthpiece comprises a first no-return valve enabling the flow of said breathable gas during inhalation, and a second no-return valve enabling the flow of e led gas during exhalation.

19. The second stage regulator of claim 15 wherein said regulator housing includes a tube and an adapter wherein said adapter is adapted to engage said tube and includes said first connection member.

20. The second stage regulator of claim 15 wherein said unitary housing includes a vent opening through which exhaled gas may pass during exhalation; and said regulator housing further comprises an exhaust conduit having a first opening in fluid communication with the ambient and a second opening adapted to establish fluid communication with said vent opening.

21. The second stage regulator of claim 15 wherein said regulator housing further comprises: an exhaust opening adapted to establish fluid communication between said inhalation chamber and the ambient; and a sealing member to block flow through said exhaust opening in at least one direction.

22. A second stage regulator for conveying a breathable gas to a diver comprising:

a regulator housing having an inhalation chamber, a port opening, a first connection member, and a demand valve in communication with said inhalation chamber that releases said breathable gas to said port opening in response to inhalation through said port opening; and a mouthpiece attachable to said regulator housing, said mouthpiece comprising:

a unitary housing having an inlet opening, a mouthgrip opening, and a second connection member, said second connection member adapted to engage said first connection member; and at least one fluid pathway in said unitary housing adapted to establish one-way respiratory communication with said mouthgrip opening;

wherein said regulator housing further comprises:

an exhaust opening adapted to establish fluid communication between said inhalation chamber and the ambient; and a sealing member to block flow through said exhaust opening in both directions.

23. The second stage regulator of claim 22 wherein said unitary housing comprises: a body having said mouthgrip opening; and a coupler adapted to engage said body and including said inlet opening and said second connection member.

24. The second stage regulator of claim 22 wherein said unitary housing includes a vent opening through which exhaled gas may pass during exhalation; and said regulator housing further comprises an exhaust conduit having a first opening in fluid communication with the ambient and a second opening adapted to establish fluid communication with said vent opening.

25. A mouthpiece for a breathing device comprising:

a unitary housing having a mouthgrip opening and a respiratory fluid pathway;

a flow-through coupler removably insertable into said respiratory fluid pathway, said flow-through coupler including a first half of a two-portion locking connector; and a no-return valve adapted to establish one-way respiratory fluid communication with said mouthgrip opening;

wherein said flow-through coupler is adapted to convey a respiratory gas during at least some portion of the respiratory cycle.

26. The mouthpiece of claim 25 wherein said first half of a two-portion locking connector is selected from the group of connectors comprising: threaded connectors; taper lock connectors; ball and detent connectors; snap fit connectors; clamp connectors; hinge and latch connectors; magnetic connectors; and bayonet type connectors wherein a first portion is inserted into a second portion and rotated into a locked position.

27. A mouthpiece for a breathing device comprising:

a unitary housing having a mouthgrip opening and a respiratory fluid pathway;

a flow-through coupler removably insertable into said respiratory fluid pathway, said flow-through coupler including a first half of a two-portion locking connector; and an adapter having a first portion comprising the mating half of said two-portion locking connector and a second portion adapted to engage the respiratory port tube of a breathing device;

wherein said flow-through coupler is adapted to convey a respiratory gas during at least some portion of respiratory cycle.

28. The mouthpiece of claim 27 wherein said two-portion locking connector is selected from the group of connectors comprising: threaded connectors; taper lock connectors; ball and detent connectors; snap fit connectors; damp connectors; hinge and latch connectors; magnetic connectors; and bayonet type connectors wherein a first portion is inserted into a second portion and rotated into a locked position.

29. The mouthpiece of claim 27 further comprising a no-return valve adapted to establish one-way respiratory fluid communication with said mouthgrip opening.

* * * * *